United States Patent [19]

Labbe

[11] 4,398,649

[45] Aug. 16, 1983

[54] PRIMARY MANWAY COVER REMOVAL

[75] Inventor: Thomas V. Labbe, Hixson, Tenn.

[73] Assignee: Combustion Engineering, Inc., Windsor, Conn.

[21] Appl. No.: 316,571

[22] Filed: Oct. 29, 1981

[51] Int. Cl.[3] ..... B65D 45/00

[52] U.S. Cl. ..... 220/327; 220/336

[58] Field of Search ..... 220/327, 336, 328

[56] References Cited

U.S. PATENT DOCUMENTS

| | | | |
|---|---|---|---|
| 3,385,469 | 5/1968 | Gaines | 220/327 |
| 3,460,710 | 8/1969 | Vogeli | 220/327 |
| 4,248,714 | 2/1981 | Acosta | 220/327 |

*Primary Examiner*—George T. Hall

*Attorney, Agent, or Firm*—Robert L. Olson

[57] ABSTRACT

A method and apparatus for removing and replacing the primary manway cover (18) which is secured to the shell (10) of a nuclear steam generator by a multiplicity of nuts (24) and studs (22), including the steps of removing two of the studs and replacing them with two overlength special studs (30); removing the nuts (24) from all of the other studs (22); unthreading the nuts (24) on the overlength studs (30) until the cover (18) is positioned outside the ends (28) of the other studs (22); attaching (44) a cable (40) to the periphery of the cover; removing one of the overlength studs (30); and pivoting the cover (18) on the other of the overlength studs (30) out of alignment with the manway opening while supporting it by means of the cable (40).

9 Claims, 5 Drawing Figures

PRIMARY MANWAY COVER REMOVAL

BACKGROUND OF THE INVENTION

Large covers for high pressure applications are heavy, cumbersome, and not easily rigged for removal. One example of this is the cover on the manway of a nuclear steam generator. These manway covers are generally two feet in diameter, five inches thick, and weigh approximately six hundred pounds. They are secured to the vessel by a multiplicity of studs and nuts. The covers are located with their axes inclined downward about 22° from the horizontal, and are in locations where temporary scaffolding must be used for their removal and reassembly. In addition, there is some radioactivity in the area, so that personnel can only work in the area for limited periods of time.

SUMMARY OF THE INVENTION

In accordance with the invention, a method and apparatus is provided for removing and replacing the manway cover, which is secured by a plurality of studs and nuts to the shell of a nuclear steam generator, which is quick and simple, and requires very little equipment. The method does not require removal of the majority of the studs. The method includes the steps of removing two of the studs and replacing them with two overlength special studs; removing the nuts from all of the other studs; unthreading the nuts on the overlength studs until the cover is positioned outside the ends of the other studs; attaching a cable to the periphery of the cover; removing one of the overlength studs; and pivoting the cover on the other of the overlength studs out of alignment with the manway opening while supporting it by means of the cable.

DESCRIPTION OF THE PREFERRED EMBODIMENT

Figure 1:
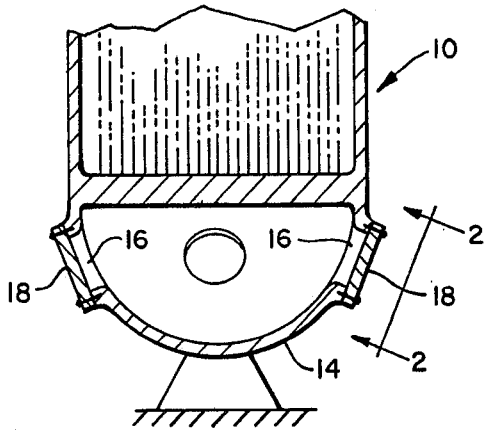
FIG. 1 is a partial side view of a nuclear steam generator showing one of the manway covers.

Looking now to FIG. 1, numeral 10 denotes the bottom portion of a nuclear steam generator, through which a radioactive, pressurized fluid is circulated to generate steam when the unit is in operation. In order to gain access to the inside of the shell or vessel 14 for inspection and repair purposes during shutdown periods, a pair of manway openings 16 are provided. These openings are sealed by covers 18 during normal operation of the nuclear steam generator. These openings are generally located at a height above the floor such that they can not be reached by personnel. Thus temporary scaffolding must be used for the cover removal. Also, this area is generally exposed to high radioactivity, and thus workers can only work for a short period of time in the area. Thus it is desirable to use only one man to remove the covers if possible. Since the covers weigh approximately 600 pounds each, this has presented problems in the past. The structure shown in FIGS. 2–5, to be described below, overcomes these problems.

Figure 2:
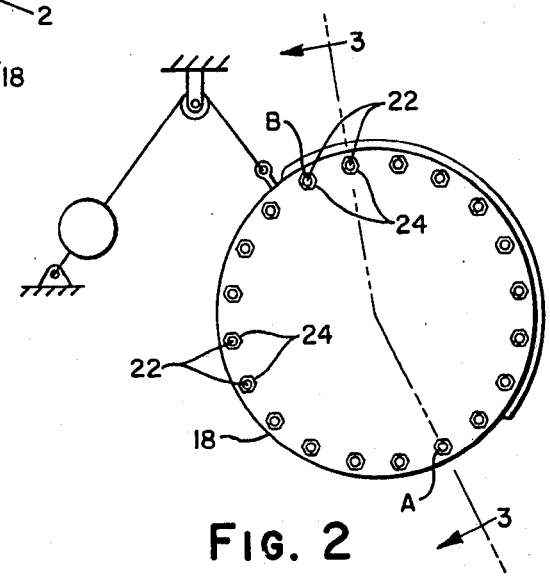
FIG. 2 is an enlarged view taken along lines 2—2 of FIG. 1.
Figure 3:
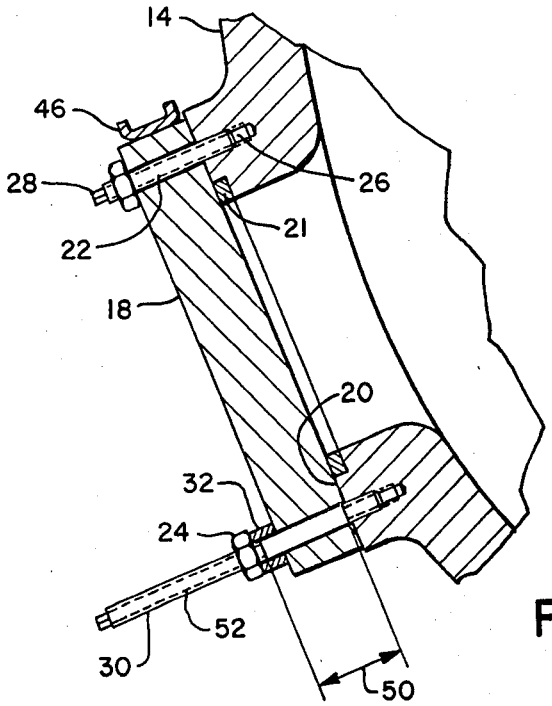
FIG. 3 is a sectional view taken on lines 3—3 of FIG. 2, after the overlength studs have been attached.

Looking now to FIGS. 2 and 3, one of the covers 18 is shown. It is secured to the flange 20 of shell 14 by a multiplicity of studs 22 and nuts 24, there being twenty shown. The studs 22 are threaded into threaded openings 26 in the flange 20. A suitable seal or gasket 21 is used between the cover and flange to ensure that there is no leakage through the cover during operation of the unit. The studs 22 have a square outer end 28, so that a wrench can be used to place the studs tightly in the flange 20, and to remove them when desired. The manner in which the cover is removed during a shutdown will now be explained. Looking in FIG. 2, the nuts 24 are removed from two diametrically opposed studs A, B. The studs A and B are then removed. They are replaced by special overlength studs 30. A sleeve 32 is slipped onto each of these overlength studs 30, and then the nuts 22 are threaded back on, hand tight, with the sleeve ends resting against the outer surface of the cover 18 (FIG. 3). The purpose of the sleeves 32 will be explained below. All of the nuts 24 are next removed, with the exception of the two on the overlength studs 30. If some of the studs 22 tend to come out when the nuts are being removed, they can be put back in place by applying a wrench to the ends 28. After this step, the nuts on the two overlength studs 30 are unthreaded, and the cover slides away from the shell by the action of gravity. These nuts are unthreaded until the inner surface of the cover 18 is located outside of the ends of studs 22 (FIG. 4), so that when the cover is pivoted, it will clear these studs.

A cable 40 is then passed through eyelet 42 (FIG. 5), which is attached to the shell 14. The end of this cable 40 is secured to an eyebolt 44 which is threadedly attached to the cover 18. A guideway 46 (FIGS. 3 and 4) attached to the periphery of the cover 18 keeps the cable from slipping off the cover periphery. A winch 48 is attached to the other end of the cable 40. The cable is run taut at this point in time, and locked as shown in phantom lines in FIG. 5. The nut on the stud 30 at location B is then taken off, and this stud 30 is also removed. The winch 48 is then used to slowly pay out cable 40, allowing the cover 18 to pivot about the remaining stud 30 by the force of gravity. The cover continues to pivot about stud 30 until it reaches the position shown in solid lines in FIG. 5. At this time, the cover permits complete access to the inside of the shell or vessel 14. All of the above can be easily and quickly accomplished by one man, thus minimizing the time personnel is exposed to the low radioactivity. After the inspection or maintenance is finished, the cover can be put back on by the reverse process set forth above.

Figure 4:
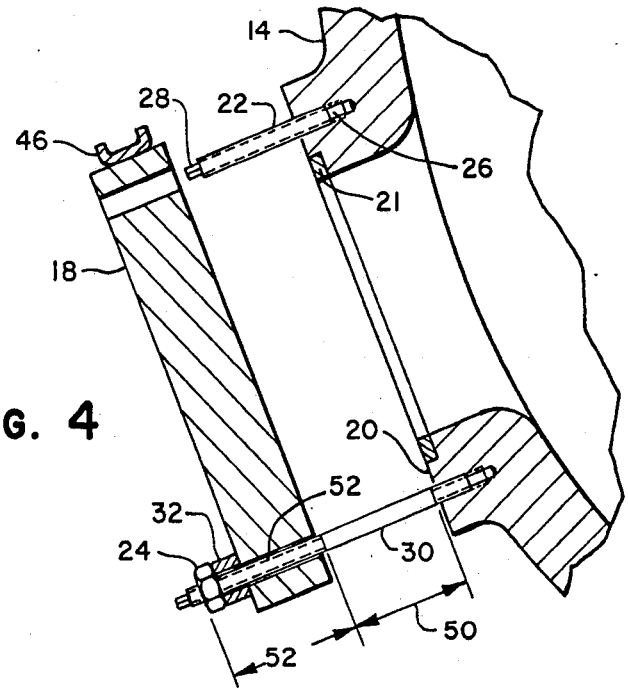
FIG. 4 is a sectional view similar to FIG. 3, with the cover partially removed from the shell.
Figure 5:
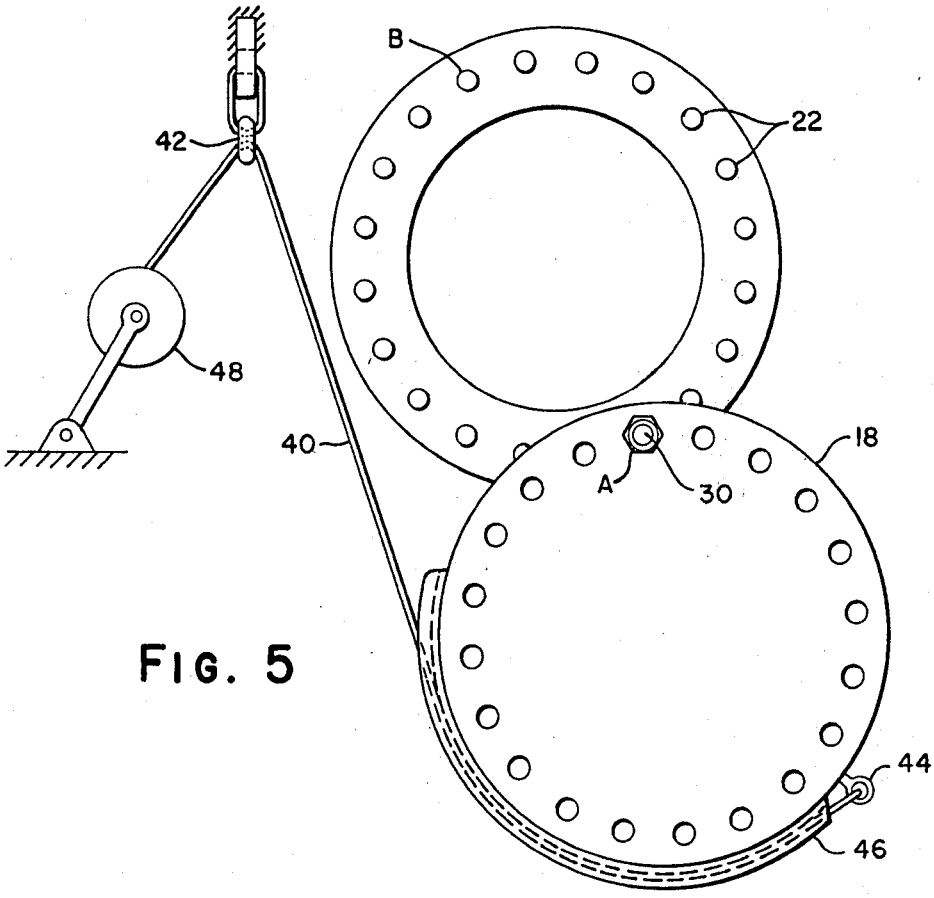
FIG. 5 is a view taken along lines 5—5 of FIG. 4, showing how the cover is pivoted out of alignment with the manway opening.

Looking now to FIGS. 3 and 4, the purpose of the sleeves 32 will be explained. The overlength studs 30 each have an unthreaded portion 50. This unthreaded portion is larger in diameter than the threaded portion, so that when the cover is pivoted, as shown in FIG. 5, it will be resting at least in part on the unthreaded portion 50. In order for the nuts to be hand tightened on the overlength studs 30 as shown in FIG. 3, a sleeve of a given length is necessary. For example, if the cover is five inches thick, and the studs 22 extend approximately seven and a half inches out from the flange 20, then a sleeve approximately four inches in length should be used. The unthreaded portion should be nine inches long. In order for the nuts on the overlength studs 30 to be unthreaded a sufficient distance to permit the cover to clear the studs 22 in order to allow it to be pivoted, the threaded portion 52 on the overlength studs 30 must be at least nine and a half inches in length. This is determined by adding the length of studs 22 (seven and a half inches) plus the nut depth (one and a half inches) plus clearance (one half inch). Thus when the nuts have been unthreaded eight inches on the overlength studs 30, the cover 18 is still riding on one inch of the unthreaded portion 50. When the cover is pivoted, the cover will not damage the threaded portion 52 of stud 30, since the unthreaded portion 50 is of a larger diameter. Thus it can be seen that a properly sized sleeve, along with the oversized unthreaded portion of the overlength studs, permits the nuts on the overlength studs to be hand tightened, and also permits the cover to be pivoted without ruining the threads on the studs, and also permits the cover to be removed without the necessity of removing all of the studs. Although only the overlength stud on which the cover is pivoted absolutely has to have an unthreaded portion and a sleeve to protect it while the cover is being pivoted, it is advantageous to provide the other overlength stud with these provisions also, so that thread damage is not caused while the cover is being slid outwardly along these studs.

I claim:

1. The method of removing a cover from an opening in a vessel, wherein the cover is secured onto the vessel by a plurality of studs whose inner ends are threaded into threaded openings in the vessel, with nuts threaded onto the outer ends, including the steps of removing a pair of substantially diametrically opposite studs and associated nuts, replacing them with two overlength special studs and nuts, removing the nuts from all of the other studs, unthreading the nuts on the overlength studs until the cover can be moved away from the shell a distance where its inner surface is positioned outside the ends of all of the other studs, attaching a cable to the cover, removing one of the overlength studs, and pivoting the cover on the other of the overlength studs out of alignment with the opening while partially supporting the cover by means of the cable.

2. In combination, a vessel, opening means in the vessel, a plurality of studs securing the cover onto the vessel, the studs having inner ends threaded into openings in the vessel, nuts cooperating with the outer ends of each of the studs, two of the studs which are substantially diametrically opposite each other being overlength, of such a length that when the nuts of the overlength studs are unthreaded a given amount, and the nuts on all of the other studs are removed and the cover moved away from the opening into contact with the nuts on the overlength studs, the inner surface of the cover is outside of the outer ends of all of the other studs, cable means attached to the periphery of the cover, guide means on the periphery of the cover to keep the cable from slipping off the periphery of the cover, and means for causing controlled pivoting about one of the overlength studs until the cover permits access to the vessel interior, after the other overlength stud and its associated nut has been removed.

3. The combination set forth in claim 2, wherein the overlength stud on which the cover is pivoted has an unthreaded portion of larger diameter than the threaded portion, located such that when the cover is pivoted, it pivots at least partially on the unthreaded portion.

4. The combination set forth in claim 3, wherein the overlength stud on which the cover is pivoted has a sleeve on it outside the cover, of sufficient length to permit its associated nut to be tightened.

5. The combination set forth in claim 4, wherein both overlength studs have unthreaded portions identical to each other, and identical sleeves surround each of the overlength studs.

6. The combination set forth in claim 5, wherein the cover is located such that it moves by gravity away from the vessel.

7. The combination set forth in claim 6, wherein the overlength studs are located such that the force causing pivoting of the cover is gravity.

8. The combination set forth in claim 7, including winch means attached to the cable means.

9. The combination set forth in claim 8, wherein the vessel is a nuclear steam generator.

* * * * *